US005810572A

United States Patent [19]

Yamamoto et al.

[11] Patent Number: 5,810,572

[45] Date of Patent: Sep. 22, 1998

[54] SCROLL COMPRESSOR HAVING AN AUXILIARY BEARING FOR THE CRANKSHAFT

[75] Inventors: Shuichi Yamamoto; Kiyoshi Sano, both of Otsu; Syouzou Hase, Hikone; Takashi Morimoto, Nagaokakyo; Katsuharu Fujio, Shiga-ken, all of Japan

[73] Assignee: Matsushita Electric Industrial Co., Ltd., Osaka-fu, Japan

[21] Appl. No.: 713,480

[22] Filed: Sep. 13, 1996

Related U.S. Application Data

[62] Division of Ser. No. 590,464, Jan. 23, 1996.

[30] Foreign Application Priority Data

Jan. 23, 1995 [JP] Japan ..... 7-8432

[51] Int. Cl.[6] ..... F04C 18/04; F04C 29/02

[52] U.S. Cl. ..... 418/55.6

[58] Field of Search ..... 418/55.1, 55.6

[56] References Cited

U.S. PATENT DOCUMENTS

| | | | |
|---|---|---|---|
| 5,197,868 | 3/1993 | Caillat et al. | 418/55.6 |
| 5,370,513 | 12/1994 | Fain | 418/55.6 |
| 5,391,066 | 2/1995 | Sawai et al. | 418/55.6 |
| 5,445,507 | 8/1995 | Nakamura et al. | 418/55.1 |
| 5,494,422 | 2/1996 | Ukai et al. | 418/55.1 |

FOREIGN PATENT DOCUMENTS 61-14492 1/1986 Japan .

*Primary Examiner*—John J. Vrablik

*Attorney, Agent, or Firm*—Wenderoth, Lind & Ponack, L.L.P.

[57] ABSTRACT

A scroll compressor includes a stationary scroll member accommodated in a closed housing and having a stationary end plate and a stationary scroll wrap protruding axially from the stationary end plate, and also includes an orbiting scroll member accommodated in the closed housing and having an orbiting end plate and an orbiting scroll wrap protruding axially from the orbiting end plate so as to engage with the stationary scroll wrap to define a plurality of working pockets therebetween. A crankshaft is provided to drive the orbiting scroll member, and the crankshaft includes a main shaft and an auxiliary shaft on opposite sides thereof. A main bearing supports the main shaft of the crankshaft. A bearing frame is secured to an inner surface of the closed housing, and an auxiliary bearing is mounted to the bearing frame to support the auxiliary shaft of the crankshaft. The closed housing has an oil sump formed therein to accommodate lubricating oil, and an oil passage is formed in the bearing frame so as to extend into the oil sump. An oil feed device is mounted on the bearing frame and engages with one end of the auxiliary shaft to feed the lubricating oil from the oil sump through the oil passage.

6 Claims, 5 Drawing Sheets

SCROLL COMPRESSOR HAVING AN AUXILIARY BEARING FOR THE CRANKSHAFT

This is a Rule 60 Divisional application of Ser. No. 08/590,464, filed Jan. 23, 1996.

BACKGROUND OF THE INVENTION

1. Field of the Invention

The present invention relates to a scroll compressor for use in an air conditioner.

2. Description of Related Art

In general, when a room air conditioner is used for both heating and cooling purposes, the evaporation temperature and condensation temperature to be set change variously. Where a scroll compressor, which is obliged to take a certain volume ratio for structural reasons, is employed in the room air conditioner, it is considerably difficult to select the volume ratio of the scroll compressor. Accordingly, a relatively large volume ratio has been hitherto selected in order to ensure the performance of the scroll compressor in any working range.

However, when a scroll compressor having a large volume ratio is operated at a relatively low cooling or heating load, the scroll compressor is considerably reduced in efficiency due to excessive compression peculiar thereto. In contrast, when a scroll compressor having a very small volume ratio is operated at a relatively high load, insufficient compression is caused, resulting in a considerable reduction in efficiency.

To overcome this problem, Japanese Laid-Open Patent Publication (unexamined) No. 61-14492 discloses a scroll compressor with a discharge valve wherein the volume ratio is set to be smaller than that determined by the condensation temperature and evaporation temperature during a heat pump cycle.

However, this compressor has the following drawbacks. The volume ratio determined by the evaporation temperature and condensation temperature used during the actual heating operation is relatively small and, hence, insufficient compression is brought about for almost the whole operating time, which in turn causes a back flow of the discharge gas, thus considerably reducing the compressor efficiency.

Although the discharge valve is provided so as to reduce the back flow, if a spring constant thereof is set large to close it quickly, another problem, e.g., an increase of noise or the like is generated. In contrast, if the spring constant is too small, the effect of the discharge valve cannot be expected.

It is therefore difficult to reduce the annual consumption of power required for the operation of the air conditioner.

In order to enhance the reliability of the compressor, it has been also proposed to provide a compliance mechanism in the axial direction, with a tip seal mounted on only an orbiting scroll. In this case, for the purpose of minimizing inclination of the orbiting scroll which has been hitherto caused by an overturning moment specific to the scroll compressor, if the orbiting scroll is physically pressed strongly against a stationary scroll, the compressor efficiency is reduced considerably. If the force or pressure is small, the effect is reduced. It is therefore necessary to pay scrupulous attention to both the magnitude of the force or pressure and sufficient sealing so as not to reduce the compressor efficiency.

Especially, if a horizontally arranged scroll compressor is operated at high speeds, it is preferred that a crank shaft be sufficiently supported at opposite ends thereof. Moreover, an oil feed means should be provided to surely supply a lubricating oil to each bearing, resulting in an increase in manufacturing costs.

At the same time, the horizontally arranged scroll compressor is required to support an axial force acting on the crank shaft, which likewise increases costs as a result of an increase in the number of elements.

SUMMARY OF THE INVENTION

The present invention has been developed to overcome the above-described disadvantages.

It is accordingly an objective of the present invention to provide a highly efficient scroll compressor capable of considerably reducing the annual consumption of power required for the operation of an air conditioner.

Another objective of the present invention is to provide a highly reliable scroll compressor which can be manufactured at a low cost.

In accomplishing the above and other objectives, the scroll compressor according to the present invention comprises a closed housing, a stationary scroll member accommodated in the closed housing and having a stationary end plate and a stationary scroll wrap protruding axially from the stationary end plate, and an orbiting scroll member accommodated in the closed housing and having an orbiting end plate and an orbiting scroll wrap protruding axially from the orbiting end plate so as to engage with the stationary scroll wrap to define a plurality of working pockets therebetween. The orbiting scroll member is driven by a crank shaft which is in turn drivingly coupled with an electric motor and is supported by a bearing member. A rotation constraint element is provided for preventing rotation of the orbiting scroll member about its own axis while allowing it to undergo an orbiting motion relative to the stationary scroll member.

In the above-described construction, the volume ratio indicating a ratio of the volume of the working pockets at an end of suction to that at an end of compression is set to be smaller than a value corresponding to a compression ratio determined by an evaporation pressure and a condensation pressure at a performance half the rated performance during heating.

By so doing, a compression loss is reduced which has been hitherto caused by an excessive compression and an insufficient compression within a pressure range frequently used during actual driving of the air conditioner, thus enhancing the compressor efficiency and considerably reducing the annual consumption of power required for the operation of the air conditioner.

Advantageously, the scroll compressor further comprises a check valve mounted on the stationary scroll member and having a flexible arm and a generally round flapper integrally formed therewith. It is preferred that the flapper has a size or diameter greater than the width of the flexible arm to selectively open and close a discharge port defined in the stationary scroll member.

The generally round flapper may be replaced by an elongated flapper having a width greater than the width of the flexible arm.

This construction makes it possible to set the closing speed of the check valve high when the compressor is operated at a relatively high heating or cooling load, i.e., at a high compression ratio and to reduce impact noise generated when the check valve is closed. Accordingly, a back flow is positively prevented and, hence, the compressor efficiency is greatly improved.

It is preferred that the check valve is received in a recess defined in the stationary scroll member and having a depth approximately equal to or less than a maximum height of lift of the check valve. This arrangement increases a resistance to the back flow without greatly increasing costs, to thereby prevent a reduction in compressor efficiency.

Alternatively, the volume ratio may be set to be approximately equal to a value corresponding to a compression ratio determined by an evaporation temperature and a condensation temperature within a temperature range of an open air having a high frequency of occurrence in atmospheric data.

By so doing, a phenomenon of insufficient compression which is marked at a relatively high compression ratio is prevented, resulting in an increase in compressor efficiency. The effect is large particularly when the compressor is driven at a constant speed.

Advantageously, the orbiting scroll wrap has a tip seal mounted thereon for axially sealing the working pockets. In this case, the number of turns of the stationary and orbiting scroll wraps is determined so that the working pockets may be formed between an external wall surface of the stationary scroll wrap and an internal wall surface of the orbiting scroll wrap in a direction in which an overturning moment acting to incline the orbiting scroll member takes a maximum value during one rotation of the crank shaft.

This construction can reduce a pressing force to press the orbiting scroll member against the stationary scroll member while preventing a thrust force from reducing the compressor efficiency. This construction can also prevent leakage between the free end of the orbiting scroll wrap and the stationary end plate which has been hitherto caused by the overturning moment, resulting in a considerable increase in compressor efficiency.

Again advantageously, the crank shaft has a main shaft and an auxiliary shaft formed on opposite sides thereof. In this case, the scroll compressor further comprises a bearing member having a main bearing for supporting the main shaft of the crank shaft, a bearing frame secured to an inner surface of the closed housing, an auxiliary bearing mounted on the bearing frame for supporting the auxiliary shaft of the crank shaft, and an oil feed means mounted on the bearing frame for feeding a lubricating oil.

Because the oil feed means and the auxiliary bearing are mounted on the same element, the manufacturing costs can be considerably reduced.

It is preferred that the auxiliary bearing has a bush for radially supporting the auxiliary shaft of the crank shaft and a flange integrally formed with the bush for axially supporting the crank shaft.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
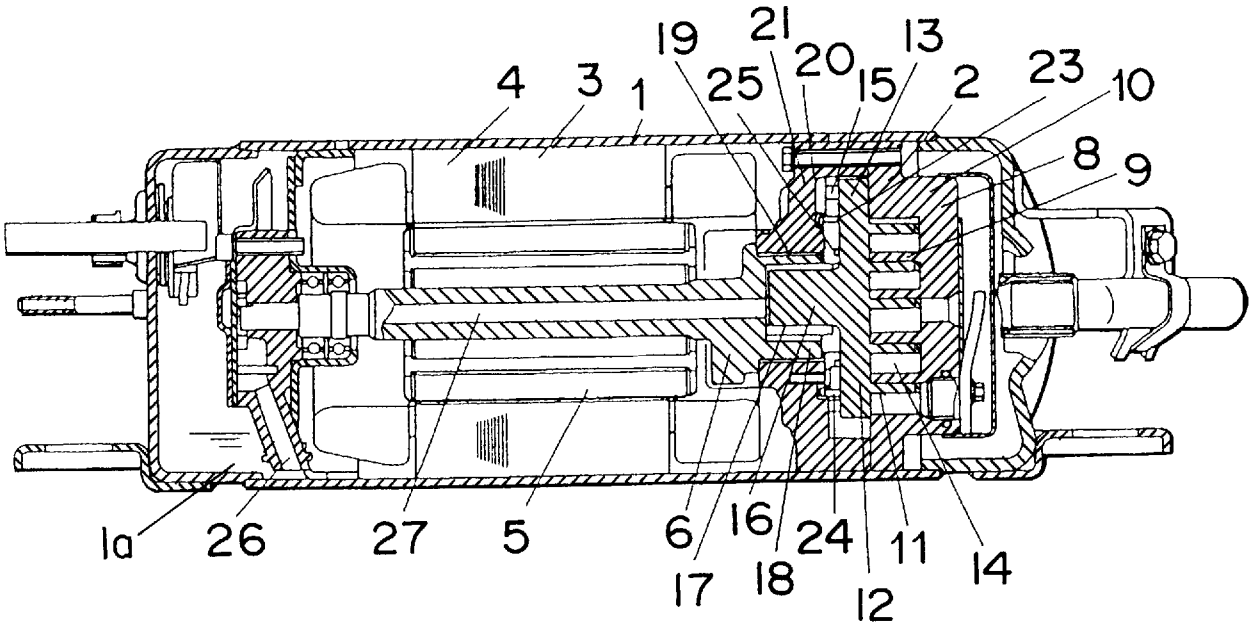
FIG. 1 is a vertical elevation view, partly in cross section, of a scroll compressor according to the present invention.

Referring now to the drawings, there is shown in FIG. 1 a scroll compressor embodying the present invention. The scroll compressor shown therein comprises a generally cylindrical closed housing 1, a compression mechanism 2 accommodated within the closed housing 1, and an electric motor 3 for driving the compression mechanism 2.

The electric motor 3 includes a stator 4 secured to the inner surface of the closed housing 1 and a rotor 5 drivingly coupled with a crank shaft 6 which in turn drives the compression mechanism 2. The compression mechanism 2 includes a stationary scroll 10 having a stationary end plate 8 and a stationary scroll wrap 9 integrally formed therewith and protruding axially from one end surface thereof, and also includes an orbiting scroll 13 having an orbiting end plate 12 and an orbiting scroll wrap 11 integrally formed therewith and protruding axially from one end surface thereof. The stationary and orbiting scroll wraps 9 and 11 engage with each other to define a plurality of volume-variable, sealed working pockets 14 therebetween. The compression mechanism 2 further includes a rotation constraint element 15 for preventing rotation of the orbiting scroll 13 about its own axis while allowing it to undergo an orbiting motion relative to the stationary scroll 10, an orbiting drive shaft 16 integrally formed with the orbiting end plate 12 on the side opposite to the orbiting scroll wrap 11, and an eccentric engaging portion 17 received in a recess defined in a main shaft 18 of the crank shaft 6 with the orbiting drive shaft 16 received in the eccentric engaging portion 17. The compression mechanism 2 also includes a bearing member 21 having a main bearing 19 for supporting the main shaft 18 of the crank shaft 6, and a plate-like member 24 mounted on the bearing member 21 and having an axial movement restraint surface 23 for restraining an axial movement of the orbiting scroll 13. The plate-like member 24 has a partition ring 25 mounted thereon for partitioning the rear surface of the orbiting end plate 20 into an inner area, on which the discharge pressure acts, and an outer area lying radially outwardly of the inner area on which a pressure lower than the discharge pressure acts.

An oil feed mechanism 26 is mounted on one end of the crank shaft 6 to feed a lubricating oil accommodated in an oil sump 1*a* formed within the closed housing 1 to the inner area lying inwardly of the partition ring 25 through a through-hole 27 defined in the crank shaft 6.

Figure 2:
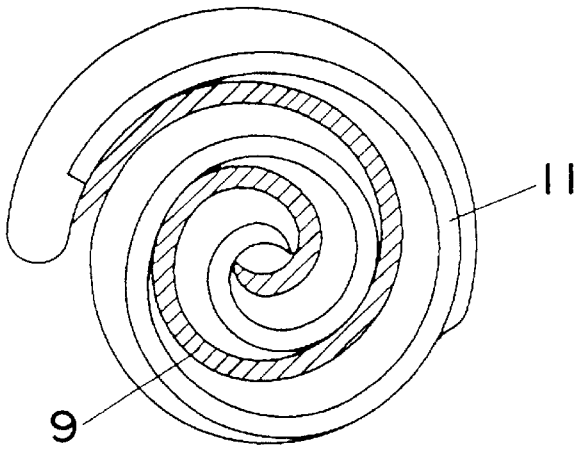
FIG. 2 is a schematic view of stationary and orbiting scroll wraps mounted in the scroll compressor of FIG. 1, particularly illustrating engagement of the two scroll wraps.

FIG. 2 depicts the stationary and orbiting scroll wraps 9 and 11 in engagement with each other, with the stationary scroll wrap 9 indicated by oblique lines. This figure indicates the case where the volume ratio, i.e., the ratio of the volume of the working pockets 14 at the suction end to that at the compression end has been set to approximately 2.1. In this case, when an R-22 refrigerant is employed and the ratio of specific heats is estimated to be 1.12, the compression ratio is about 2.3. As a matter of course, if a different refrigerant is employed, the compression ratio varies depending on the ratio of specific heats.

Figure 3:
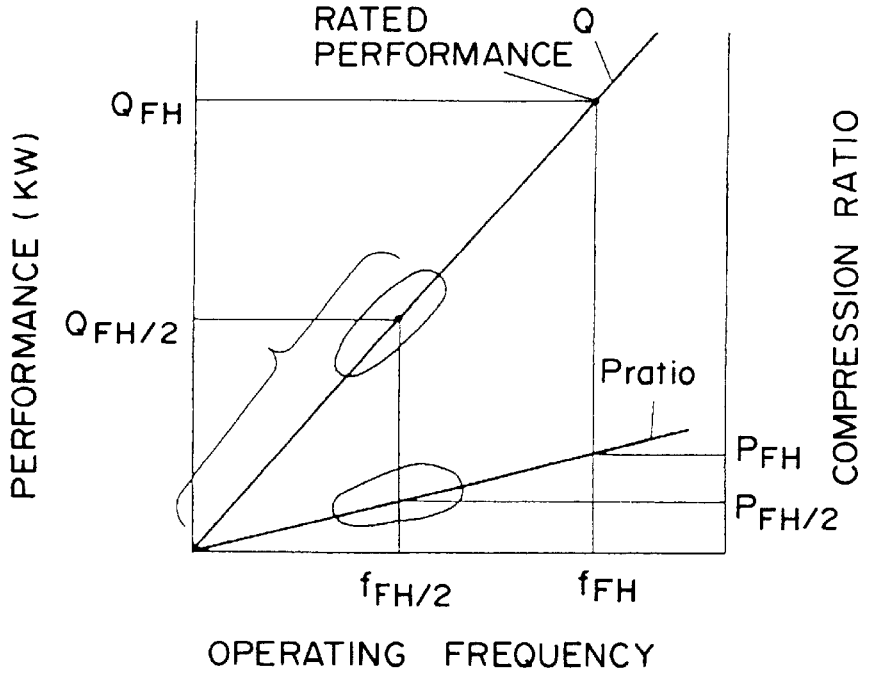
FIG. 3 is a graph indicating a relationship between the performance and the operating frequency and that between the compression ratio and the operating frequency.

FIG. 3 schematically depicts a relationship between the performance and the operating frequency and that between the compression ratio and the operating frequency. In this figure, $Q_{FH}$ and $QF_{H/2}$ indicate a rated performance and a ½ rated performance during heating, respectively, while $P_{FH}$ and $P_{FH/2}$ indicate operating compression ratios corresponding thereto, respectively.

It is to be noted here that the ½ rated performance is not necessarily required to be strictly ½ of the rated performance, but is set within a range indicated by an ellipse in FIG. 3. In ordinary air conditioners, $P_{FH/2}$ ranges from 2.1 to 2.5 which corresponds to a range from about 1.9 to about 2.3 in volume ratio.

The annual power consumption of the air conditioners is generally determined by the performance at the rated operation and that at the ½ rated operation. In particular, the annual power consumption is greatly affected by the performance at the ½ rated operation. For this reason, setting the volume ratio to a value within the aforementioned range (1.9 to 2.3) increases the frequency at which the scroll compressor is operated under optimum conditions, resulting in a considerable reduction in annual power consumption.

More specifically, the volume ratio is set to be smaller than a value corresponding to a compression ratio determined by an evaporation pressure and a condensation pressure at a performance half the rated performance during heating.

According to JIS (Japanese Industrial Standard), the temperature of the open air having a high frequency of occurrence in a mild climate ranges from about 6° C. to about 10° C. At such temperatures, the air conditioner is operated at compression ratios within the range indicated by an ellipse in FIG. 3. Accordingly, setting the volume ratio corresponding to such compression ratios eliminates operations of insufficient compression, thus greatly reducing the annual power consumption.

More specifically, the volume ratio is set to be approximately equal to a value corresponding to a compression ratio determined by an evaporation temperature and a condensation temperature within a temperature range of the open air having a high frequency of occurrence in atmospheric data.

Figure 4:
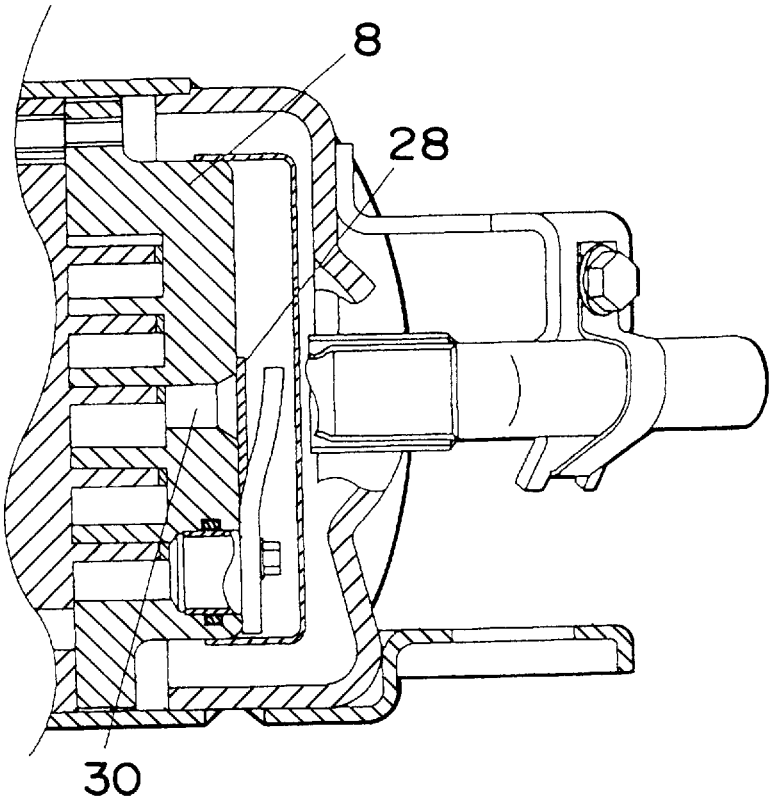
FIG. 4 is a fragmentary vertical elevation view, partly in cross section, of one side of the scroll compressor, particularly illustrating a check valve mounted on a stationary scroll so as to cover a discharge port defined therein.

As shown in FIG. 4, the stationary end plate 8 has a discharge port 30 defined therein so as to extend therethrough and a check valve 28 mounted thereon so as to cover the discharge port 30.

Figure 5A:
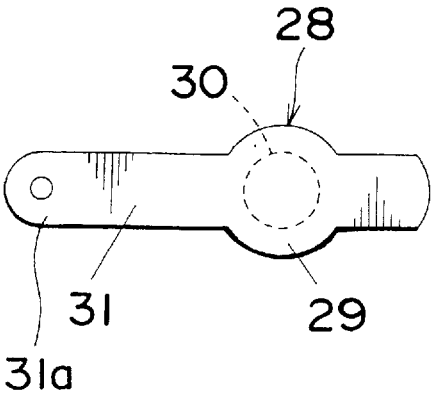
FIG. 5A is a top plan view of the check valve shown in FIG. 4.

As shown in FIG. 5A, the check valve 28 is of a one-piece construction and includes a flexible arm 31 having one end 31*a* secured to the stationary end plate 8 and a generally round flapper 29 integrally formed with the other end of the flexible arm 31 and having a size or diameter greater than the width of the flexible arm 31 to selectively open and close the discharge port 30.

Figure 5B:
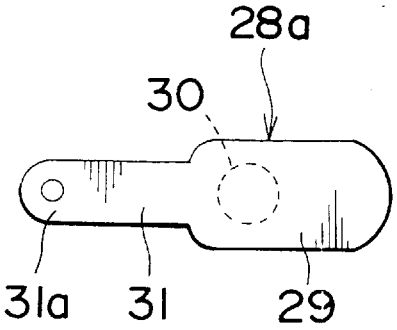
FIG. 5B is a view similar to FIG. 5A, but illustrating a modification thereof.

FIG. 5B depicts a modification of the check valve 28 of FIG. 5A. The check valve 28*a* of FIG. 5B includes a flexible arm 31 of a shape substantially identical to that of the check valve 28 and an elongated flapper 29 integrally formed with the flexible arm 31 and having a width greater than that of the flexible arm 31.

Because the volume ratio is set relatively small, when the compressor is operated at a high compression ratio of a relatively low frequency of occurrence, a back flow takes place. However, the flapper 29 of the check valve 28 or 28*a* has a wide area to reduce the area of passage of the back flow when the flapper 29 closes the discharge port 30, thus greatly reducing the amount of the back flow. Furthermore, because the flexible arm 31, which acts to strike the flapper 29 against the stationary end plate 8, has a width smaller than the size or width of the flapper 29, noise caused by an impact of the flapper 29 against the stationary end plate 8 is not increased.

Figure 6A:
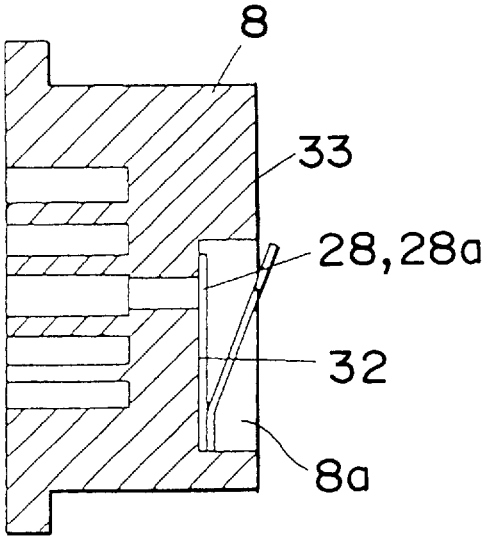
FIG. 6A is a vertical sectional view of a modification of the stationary scroll.
Figure 6B:
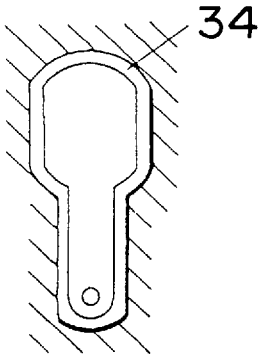
FIG. 6B is a side view of the stationary scroll of FIG. 6A, particularly illustrating the shape of the check valve and that of a recess defined in the stationary scroll.

Although in FIG. 4 the stationary end plate 8 has a generally flat top on which the check valve 28 or 28*a* is mounted, the stationary end plate 8 has a recess 8a defined therein with the check valve 28 or 28*a* received in the recess 8*a*, as shown in FIGS. 6A and 6B. The recess 8*a* has a shape substantially identical to and slightly greater than that of the check valve 28 or 28*a*, and also has a depth approximately equal to or less than the maximum height of lift of the check valve 28 or 28*a*. As the check valve 28 or 28*a* closes the discharge port 30, the area of a passage 34 through which the compressed gas flows is greatly reduced to thereby prevent the back flow, resulting in a considerable increase in compressor efficiency.

Figure 7:
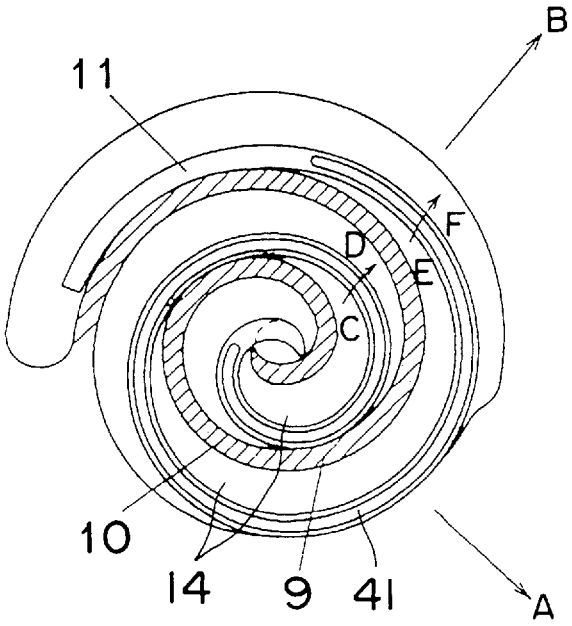
FIG. 7 is a view similar to FIG. 2, but illustrating a modification thereof.

FIG. 7 depicts a position at which the stationary and orbiting scroll wraps 9 and 11 engage with each other when the discharge is started or the compression is completed, with the stationary scroll 10 indicated by oblique lines. At that time, the overturning moment which acts to incline the orbiting scroll 13 takes a maximum value. In this figure, an arrow A indicates the direction in which the crank is made eccentric, while an arrow B indicates the direction in which the maximum overturning moment acts.

In this case, the number of turns of the stationary and orbiting scroll wraps 9 and 11 is determined so that the working pockets 14 may be formed between an external wall surface of the stationary scroll wrap 9 and an internal wall surface of the orbiting scroll wrap 11 in a direction in which the overturning moment takes a maximum value during one rotation of the crank shaft 6.

At the position indicated in FIG. 7, the orbiting scroll 13 is inclined by the action of the overturning moment and, hence, a portion of the orbiting scroll wrap 11 and a portion of the orbiting end plate 12 move away from the stationary end plate 8 and the stationary scroll wrap 9, respectively. This phenomenon enlarges gaps between the stationary and orbiting scrolls 10 and 13 and has hitherto increased leakage, which has in turn caused a considerable reduction in performance. The gaps are made maximum in the direction indicated by the arrow B and, hence, there is a good chance that leakage takes place from C to D and from E to F in FIG. 7. Although the conventional scroll compressor having an axial compliance mechanism is provided with no tip seals, the scroll compressor of the present invention is provided with both a compliance mechanism and a tip seal mounted on only the orbiting scroll wrap 11, to thereby prevent leakage from the gaps.

Figure 8:
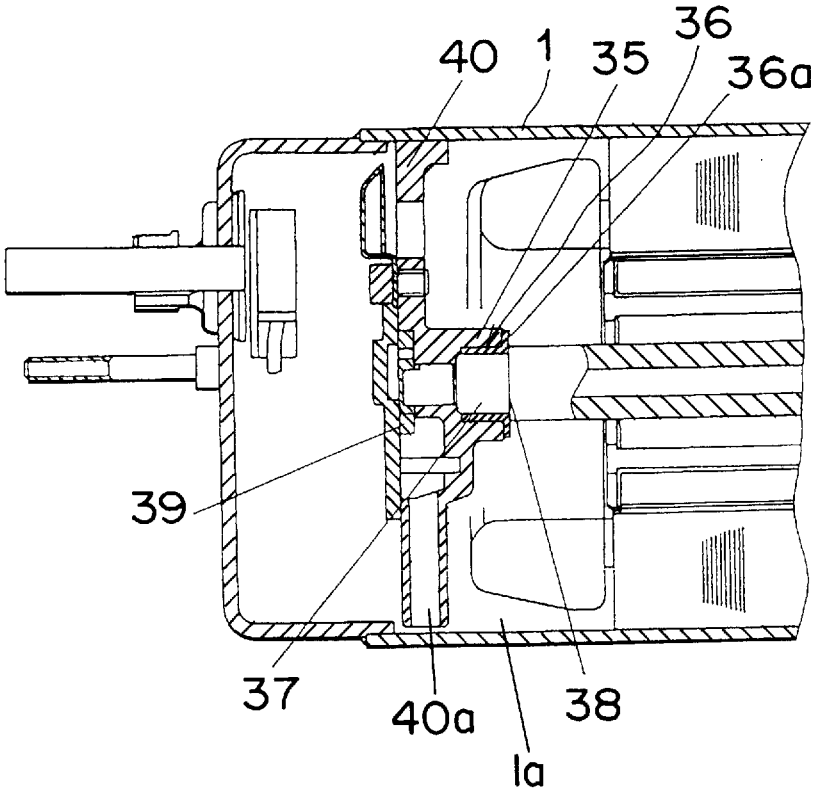
FIG. 8 is a fragmentary vertical elevation view, partly in cross section, of the other side of the scroll compressor, illustrating a modification thereof.

FIG. 8 depicts an auxiliary bearing 35 and an oil feed means 39 mounted in a scroll compressor according to a modification of the present invention. The auxiliary bearing 35 is made up of a bushing 36 for radially supporting an auxiliary shaft 37 of the crank shaft 6 and a flange 36*a* integrally formed with the bushing 36 for axially supporting a thrust receiver 38 formed on one end of the crank shaft 6. The oil feed means 39 is mounted on a bearing frame 40 secured to the inner surface of the closed housing 1 and having an oil passage 40*a* defined therein to supply each bearing with the lubricating oil from the oil sump 1*a*. Although in this embodiment a positive displacement oil feed means is employed, a differential pressure type oil feed means is also applicable to the present invention.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor comprising:

a closed housing having an oil sump formed therein to accommodate a lubricating oil;

a stationary scroll member accommodated in said closed housing and having a stationary end plate and a stationary scroll wrap protruding axially from said stationary end plate;

an orbiting scroll member accommodated in said closed housing and having an orbiting end plate and an orbiting scroll wrap protruding axially from said orbiting end plate so as to engage with said stationary scroll wrap to define a plurality of working pockets therebetween;

a crank shaft for driving said orbiting scroll member, said crank shaft having a main shaft and an auxiliary shaft formed on opposite sides thereof;

an electric motor drivingly coupled with said crank shaft;

a rotation constraint element for preventing rotation of said orbiting scroll member about its own axis while allowing said orbiting scroll member to undergo an orbiting motion relative to said stationary scroll member;

a bearing member having a main bearing for supporting said main shaft of said crank shaft;

a bearing frame secured to an inner surface of said closed housing and having an oil passage formed therein so as to extend downwardly into said oil sump;

an auxiliary bearing mounted on said bearing frame for supporting said auxiliary shaft of said crank shaft; and an oil feed device mounted on said bearing frame and engaging with one end of said auxiliary shaft for feeding the lubricating oil in said oil sump through said oil passage.

2. A scroll compressor according to claim 1, wherein said oil passage is formed in said bearing frame so as to extend in a radial direction.

3. A scroll compressor according to claim 1, wherein said crank shaft axially bears directly against said auxiliary bearing.

4. A scroll compressor comprising:

a closed housing having an oil sump therein to accommodate a lubricating oil;

a stationary scroll member accommodated in said closed housing and having a stationary end plate and a stationary scroll wrap protruding axially from said stationary end plate;

an orbiting scroll member accommodated in said closed housing and having an orbiting end plate and an orbiting scroll wrap protruding axially from said orbiting end plate so as to engage with said stationary scroll wrap to define a plurality of working pockets therebetween;

a crank shaft for driving said orbiting scroll member, said crank shaft having a main shaft and an auxiliary shaft formed on opposite sides thereof;

an electric motor drivingly coupled with said crank shaft;

a rotation constraint element for preventing rotation of said orbiting scroll member about its own axis while allowing said orbiting scroll member to undergo an orbiting motion relative to said stationary scroll member;

a bearing member having a main bearing for supporting said main shaft of said crank shaft;

a bearing frame secured to an inner surface of said closed housing; and an auxiliary bearing mounted on said bearing frame and having a bushing for radially supporting said auxiliary shaft of said crank shaft and a flange integrally formed with said bushing for axially supporting said crank shaft;

wherein said bearing frame has an oil passage formed therein, extending into said oil sump and communicating said oil sump with said auxiliary bearing.

5. A scroll compressor according to claim 4, wherein said oil passage is formed in said bearing frame so as to extend in a radial direction.

6. A scroll compressor according to claim 4, wherein said crank shaft axially bears directly against said flange of said auxiliary bearing.

* * * * *